US005919073A

United States Patent [19]

Shinoda et al.

[11] Patent Number: 5,919,073

[45] Date of Patent: Jul. 6, 1999

[54] PEEP SHOW TOY AND A PEEP SHOW TOY KIT

[75] Inventors: Morio Shinoda, Ibaragi; Masashi Matsuki, Hyogo, both of Japan

[73] Assignee: Matsuki Co., Ltd., Hyogo, Japan

[21] Appl. No.: 08/804,142

[22] Filed: Feb. 20, 1997

[30] Foreign Application Priority Data

Feb. 21, 1996 [JP] Japan ..... 8-033302
Oct. 25, 1996 [JP] Japan ..... 8-283782

[51] Int. Cl.[6] ..... A63H 33/22

[52] U.S. Cl. ..... 446/219; 446/82; 446/488

[58] Field of Search ..... 446/82, 219, 476, 446/478, 488; 40/361, 362, 363, 365, 366, 427, 445, 700, 701, 703, 743

[56] References Cited

U.S. PATENT DOCUMENTS

| | | | |
|---|---|---|---|
| 248,219 | 10/1881 | Schissel | 446/219 X |
| 804,163 | 11/1905 | Olin | 446/219 |
| 1,424,453 | 8/1922 | Farr | 446/82 |
| 1,499,891 | 7/1924 | Storer | 446/147 X |
| 1,682,594 | 8/1928 | Benjamin . | |
| 3,079,959 | 3/1963 | Johnston . | |
| 3,760,939 | 9/1973 | Hawkyard . | |
| 4,365,432 | 12/1982 | McCauley et al. | 446/488 |
| 4,428,575 | 1/1984 | Kerr . | |
| 4,558,528 | 12/1985 | Cunningham | 40/365 |
| 5,014,455 | 5/1991 | Desaderata . | |
| 5,083,389 | 1/1992 | Alperin | 446/148 X |

FOREIGN PATENT DOCUMENTS

| | | | |
|---|---|---|---|
| 2248582 | 4/1992 | United Kingdom | 446/147 |

*Primary Examiner*—Robert A. Hafer
*Assistant Examiner*—Jeffrey D. Carlson
*Attorney, Agent, or Firm*—Birch, Stewart, Kolasch & Birch, LLP

[57] ABSTRACT

A peep show toy and a peep show toy kit which are simple in construction, suitable for individual use, and capable of exhibiting a landscape, a portrait, a historical picture or a narrative, are disclosed, which include a hollow cube formed by at least one planar or curved wall. At least one observation hole is provided through which an observer can peep into the hollow cube. On the inner surface of the wall which comes in sight through the observation hole, a picture is drawn in perspective with a visual point disposed at the observation hole.

3 Claims, 15 Drawing Sheets

PEEP SHOW TOY AND A PEEP SHOW TOY KIT

BACKGROUND OF THE INVENTION

1. Field of the Invention

The present invention relates to a peep show toy and a peep show toy kit for giving a three-dimensional visual image to an observer who peeps into a hollow cube or rectangular prism, the three-dimensional visual image being unrestricted by the shape of the hollow cube or rectangular prism.

2. Description of the Prior Art

A peep show per se is known. The conventional peep show is such that an observer is required to put on glasses and peep into a show box in which a plurality of pictures are turned over one after another.

Another type of the conventional peep show is such that a stereoscopic photography or video is put on a screen provided in the show box and an observer looks at it with both of his eyes through polarizing glasses, taking advantage of binocular parallax.

The aforesaid two types of conventional peep show require an intricate and elaborate apparatus and hence are suitable only for installation in a show tent or game room for business purposes and not suitable for amusing an individual on a personal basis.

A kaleidoscope provided with three long and narrow plane mirrors and patterned with moving pieces of colored paper is also known. This inexpensive toy amuses an individual on a personal basis with changes in beautiful patterns. However, the kaleidoscope exhibits only geometric patterns. It cannot exhibit a landscape, portrait, a history picture or a narrative.

SUMMARY OF THE INVENTION

A principal object of the present invention is to provide a peep show toy and a peep show toy kit which are simple in construction, suitable for individual use, and capable of exhibiting a landscape, a portrait, a historical picture or p-a narrative.

The peep show toy as defined by the present invention is characterized in that a hollow body is formed by at least one wall which is either planar or curved; at least one observation hole through which an observer can peep into the hollow body is provided at at least one place on the hollow body; and on an area of the inner surface of the hollow body where at least one wall which comes into sight contact through the observation hole, a picture is drawn in perspective with a visual point disposed at the observation hole.

In another embodiment of the peep show toy the aforesaid area of the inner surface of said at least one wall which comes into sight contact through the observation hole is either curved or made up of a plurality of planes, is made of a translucent material, and the picture is drawn in perspective in said aforesaid area with a visual point disposed at the observation hole.

In still another peep show toy, the hollow body takes the form of a hexahedron, whereby at least three walls of the hexahedron which come into sight contact through the observation hole are made of a translucent material, and pictures are drawn in perspective on the inner surfaces of the three walls with a visual point disposed at the observation hole.

The hollow body can have the form or a cube with the observation hole being provided in one of the corners. Also, members can project inwardly of the hollow body. A picture having something to do with the picture drawn on the inner surface of at least one wall is drawn on each of the members.

In yet another aspect of the peep show toy the hollow body takes the form of a rectangular prism, and the observation hole through which an observer can peep into the rectangular prism is provided in a wall which is perpendicular to the longer edges of the rectangular prism. Also pictures are drawn on the inner surface of the one wall and on the members projecting inwardly of the rectangular prism.

In another embodiment a plurality of observation holes are provided such that a situation which can be seen through one observation hole is different from that which can be seen through another observation hole.

A peep show toy kit includes at least one sheet having a plurality of translucent walls connected to each other and creased so as to form a hollow polyhedron in whole or in part. The aforesaid at least one sheet has indentations adapted to be formed into an observation hole through which an observer can peep into the hollow polyhedron aforesaid at least one sheet has been formed into the hollow. A picture is drawn in perspective on one of the two surfaces of at least one of the walls which is disposed in opposed relationship to the observation hole. A visual point for the perspective is located at the observation hole.

The hollow polyhedron can be in the form of a cube, and the observation hole is provided in one of the corners as an indentation.

Members project inwardly into the hollow polyhedron and a picture having something to do with the picture drawn on the inner surface of the aforesaid one wall is drawn on each of the members.

BRIEF DESCRIPTION OF THE DRAWINGS

For a more complete understanding of the present invention, reference may be had to the accompanying drawings in which.

DETAILED DESCRIPTION OF THE INVENTION

Figure 4:
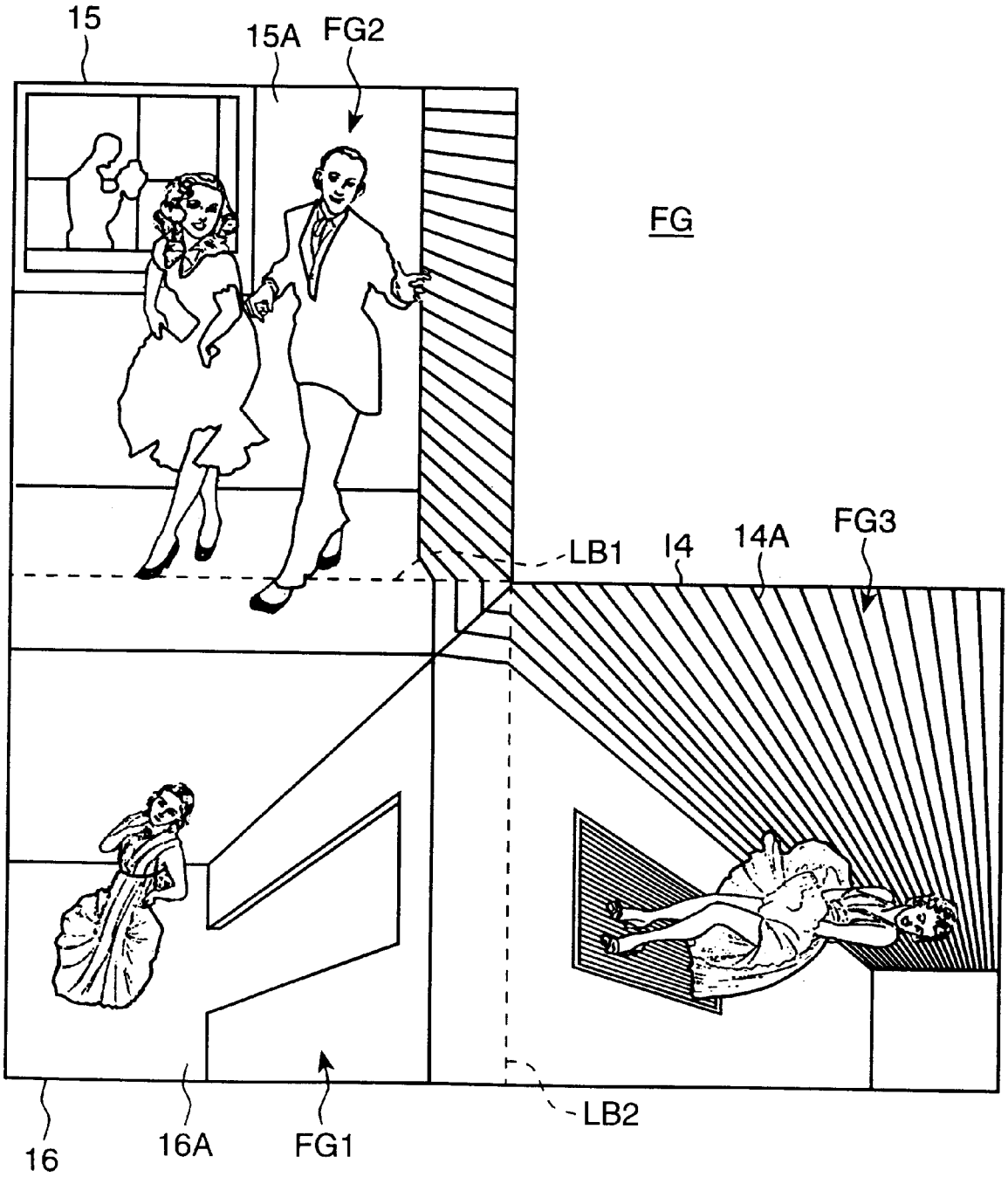
FIG. 4 is a view illustrating an example of pictures drawn on the inner surfaces of the walls thereof.

Referring now to FIG. 4, pictures FG1 to FG3 drawn in perspective on the inner surfaces of the walls are coherent as a whole. A portion of the picture FG2 drawn on the inner surface of the wall 15 is projected into the inner surface of the wall 16. A portion of the picture FG3 drawn on the inner surface of the wall 14 is projected into the inner surfaces of the walls 15 and 16. An observer thus can look at pictures FG1 to FG3 with one eye through an observation hole 21 shown in FIG. 1. This means that a visual point for the pictures FG1 to FG3 is disposed at the observation hole 21.

In FIG. 4, a border line LB1 between the walls 15 and 16 and a border line LB2 between the walls 14 and 16 are shown by dashed lines to help explain the construction, but invisible to the observer. Thus these border lines cannot be recognized by him. A plurality of parallel lines drawn on the inner surfaces of the walls 14 and 15 are creased along the border lines LB1 and LB2, but these parallel lines look like straight lines when the observer looks at them through the observation hole 21.

Since the border lines LB1 and LB2 are invisible to the observer, the three walls 14 to 16 are not recognized as three separate walls, but rather the interior of a hollow cube 10 (FIG. 1) is recognized by the observer as a three-dimensional space expressed by the pictures FG1 to FG3.

In FIG. 4, an actual border line between the picture drawn on the inner surface 15A and the picture drawn on the inner surface 16A is not the border line LB1 but a solid line horizontally drawn in the upper part of the inner surface 16A, and an actual border line between the picture drawn on the inner surface 14A and the picture drawn on the inner surface 16A is not the border line LB2 but the solid line vertically drawn parallel with the border line LB2. The pictures FG2 and FG3 are actually divided from picture FG1 by these two solid lines respectively. Consequently, the three-dimensional space expressed by the pictures FG1 to FG3 has nothing to do with the shape of the hollow cube 10 per se.

Figure 12:
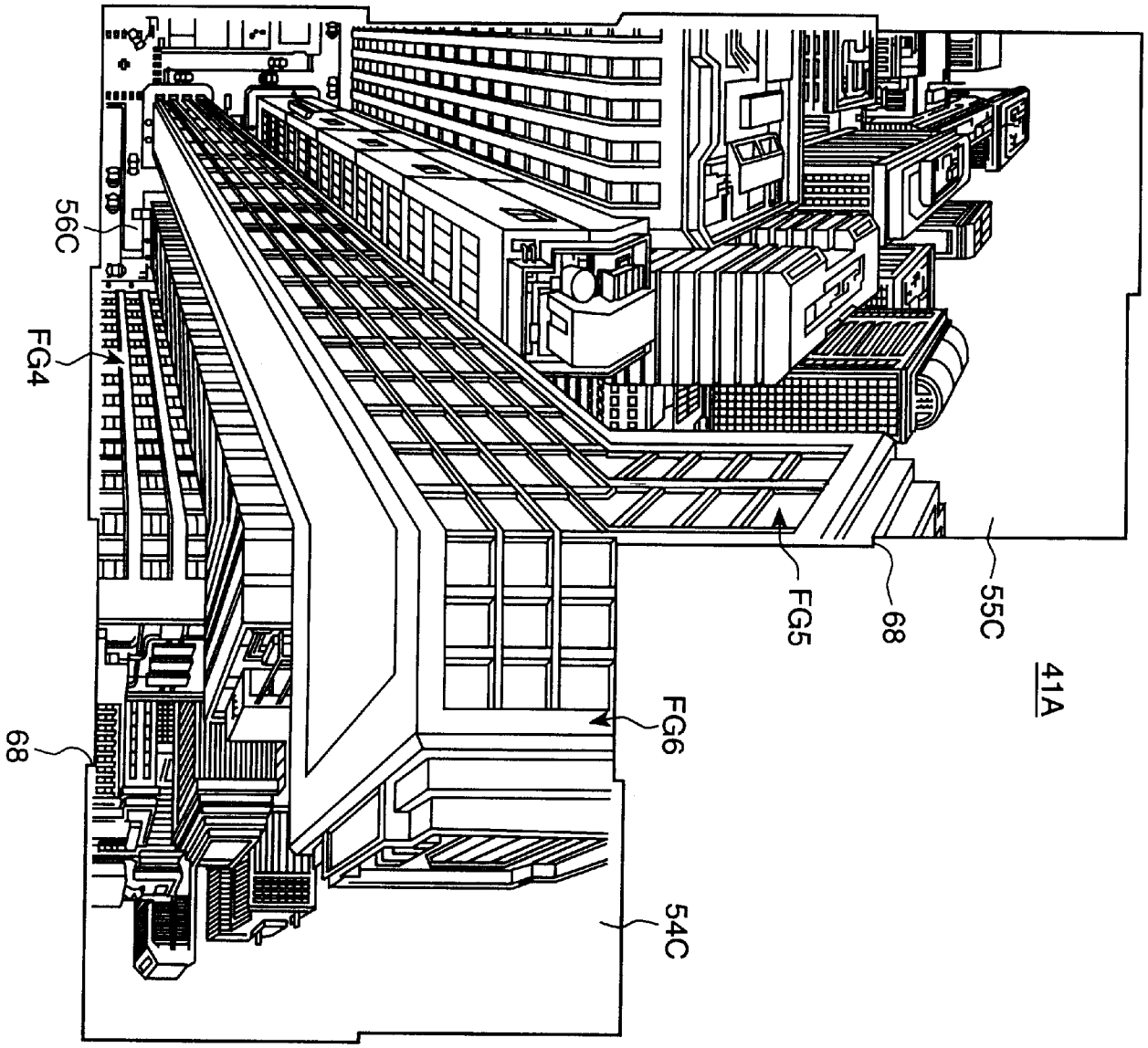
FIG. 12 shows the development of a sheet included in still another peep show toy kit in accordance with the present invention.
Figure 14:
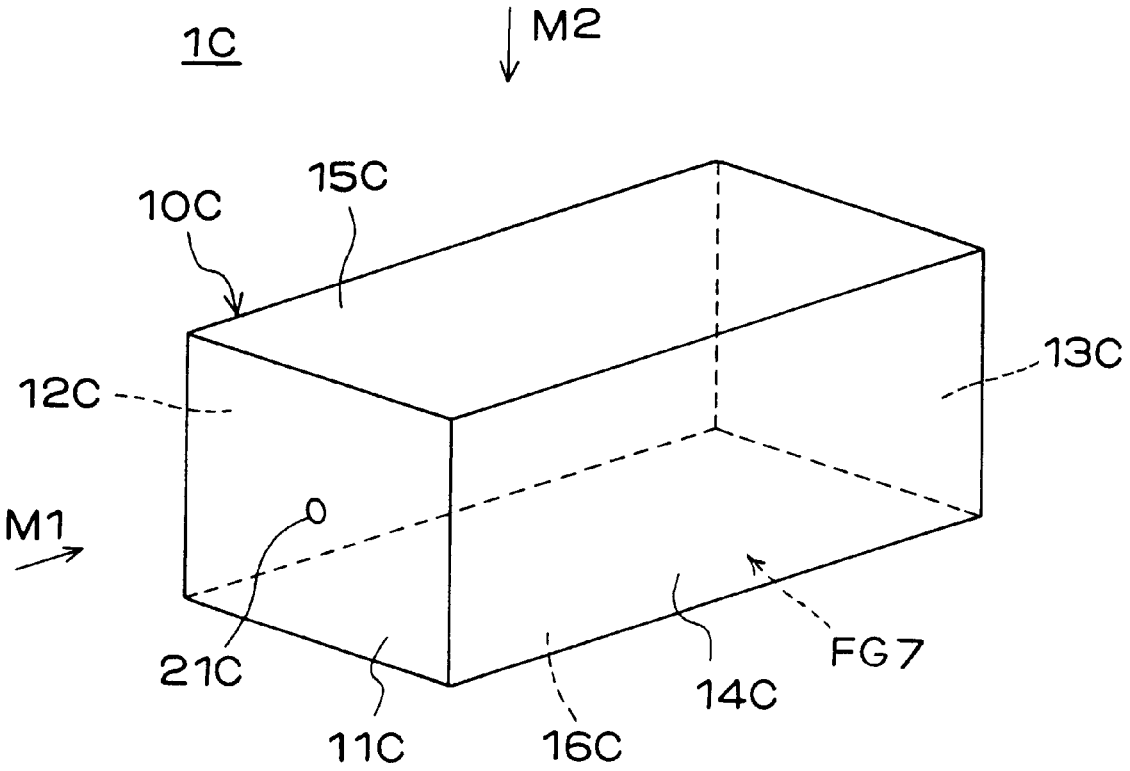
FIG. 14 is a perspective view illustrating another peep show toy in accordance with the invention.

Pictures FG4 to FG6 shown in FIG. 12 constitute a continuum. It will be noted that an example of a picture FG7 shown in FIG. 14 is illustrated in FIG. 15, in which five pictures FGv1 to FGv5 drawn on the inner surfaces of the walls exhibit a landscape, while pictures FGw1 to FGw4 are drawn on members 23 project inwardly into the hollow body.

For example, machinery such as aircraft, ships, automobiles and streetcars may be suitable for being drawn as pictures FGw. Animals such as mankind, dolls, birds and fishes may also be suitable. Plant life such as flowers, trees and fruits may also be suitable. Rockets, stars, the universe, molecules, electrons, atoms, rocks, jewels, Superman, Mickey Mouse and other characters appearing in tales, comics and commercials may also be suitable.

The projecting members 23 may be of plate type or three-dimensional and should be made in the shape of actual objects. The projecting members 23 may be directly mounted on the inner surfaces of the walls or suspended therefrom by means of thread, wire or transparent film. An adhesive may be suitable for directly mounting the projecting members 23 on the inner surfaces of the walls. Alternatively, each of the projecting members 23 may have a portion adapted to fit into a hole or slot provided in the inner surface of a wall. Alternatively, the projecting members 23 may be integrally formed with the inner surfaces of the walls.

The pictures FGv drawn on the inner surfaces of the walls are brought into prominence by the pictures FGw drawn on the projecting members 23.

When the pictures FGv are an abstract painting, landscape, portrait, history picture or narrative, any of them is brought into prominence by the pictures FGw whereby an observer can amuse himself therewith.

The peep show toy kit in accordance with the present invention includes components making for easy assembly. A person who has acquired this kit can draw pictures to his own taste on the component parts so that he can amuse himself with an assembled peep show toy of his own making.

Figure 1:
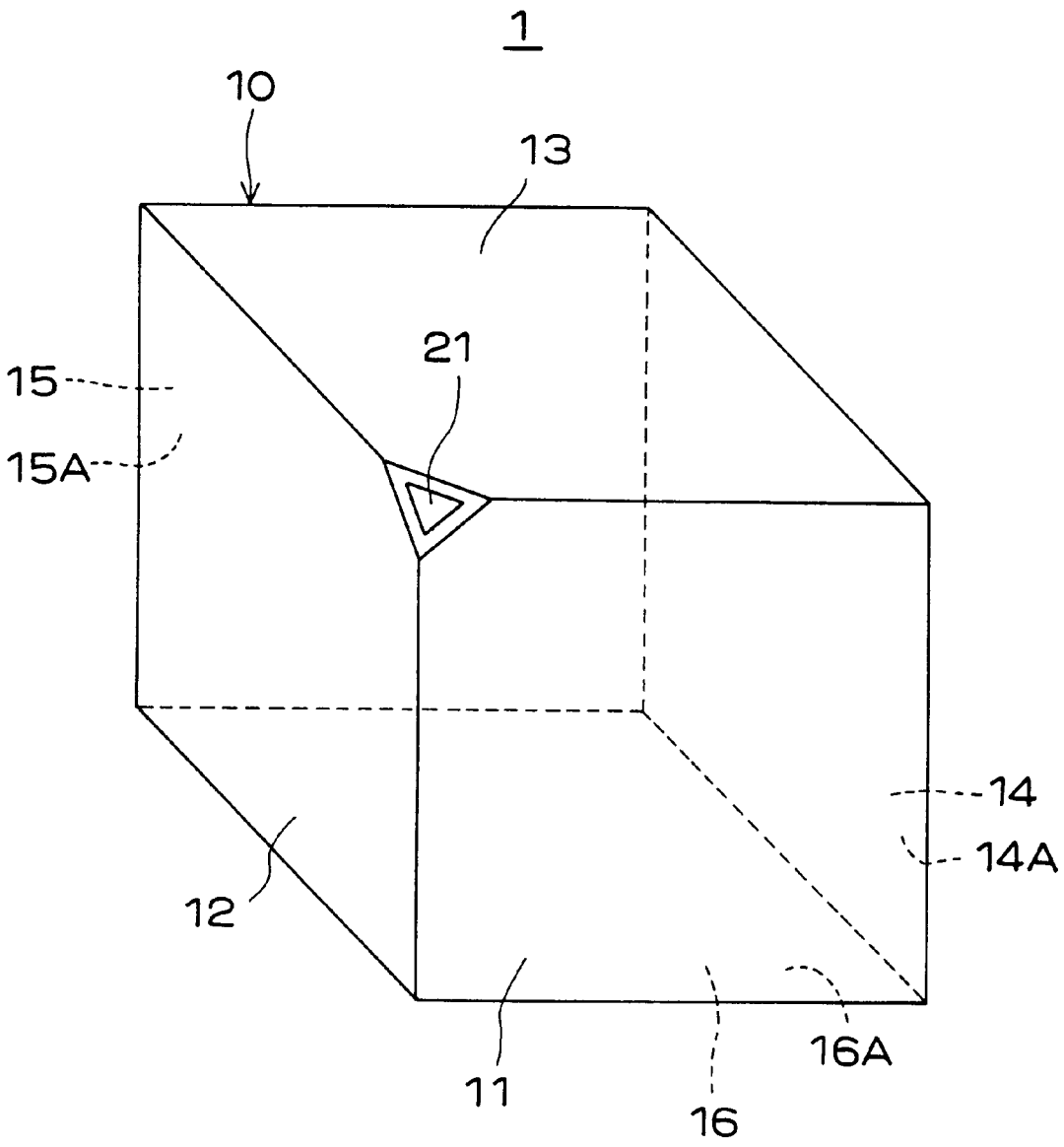
FIG. 1 is a perspective view illustrating the appearance of a peep show toy in accordance with the present invention.
Figure 2:
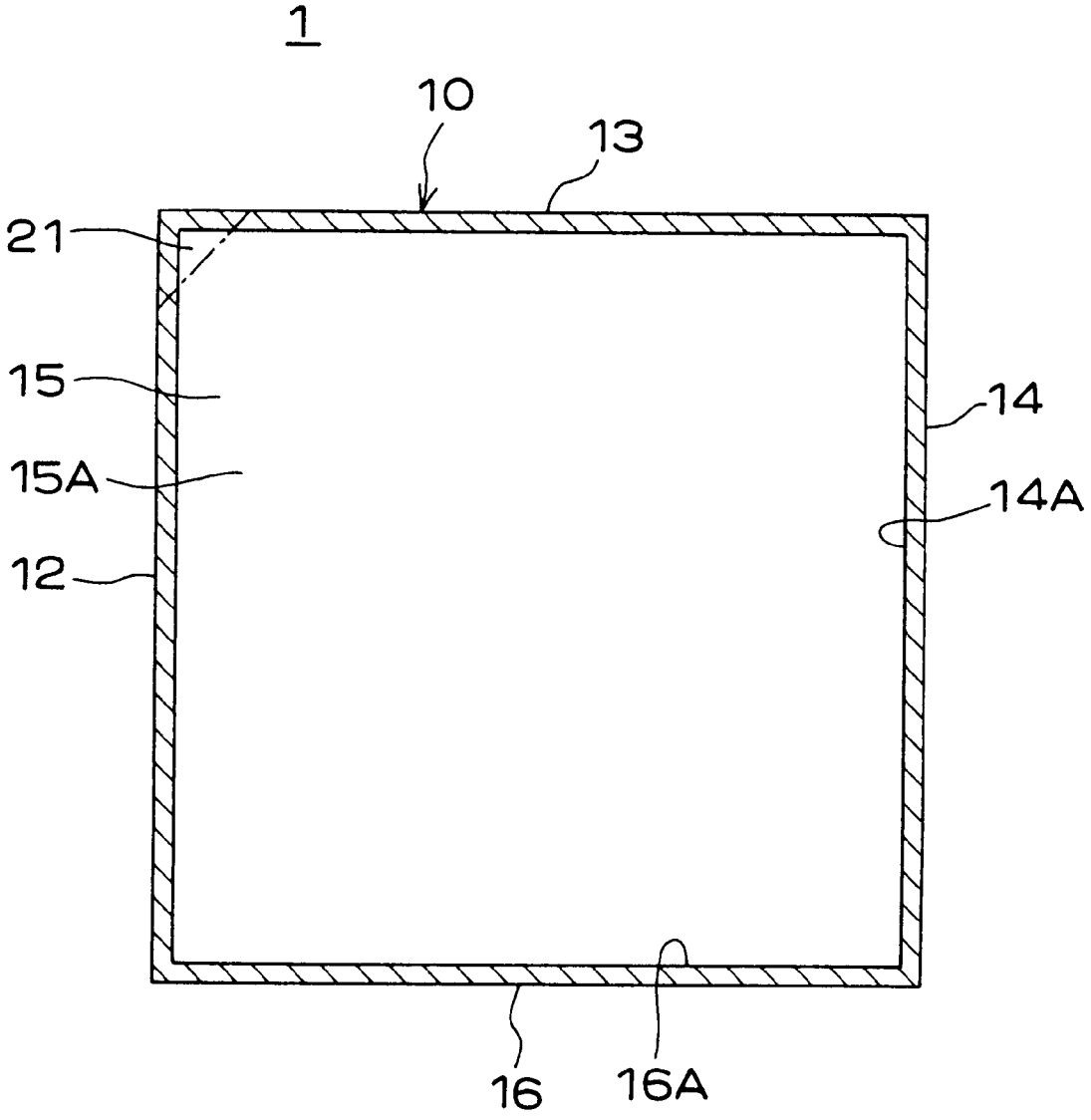
FIG. 2 is a sectional view thereof.
Figure 3:
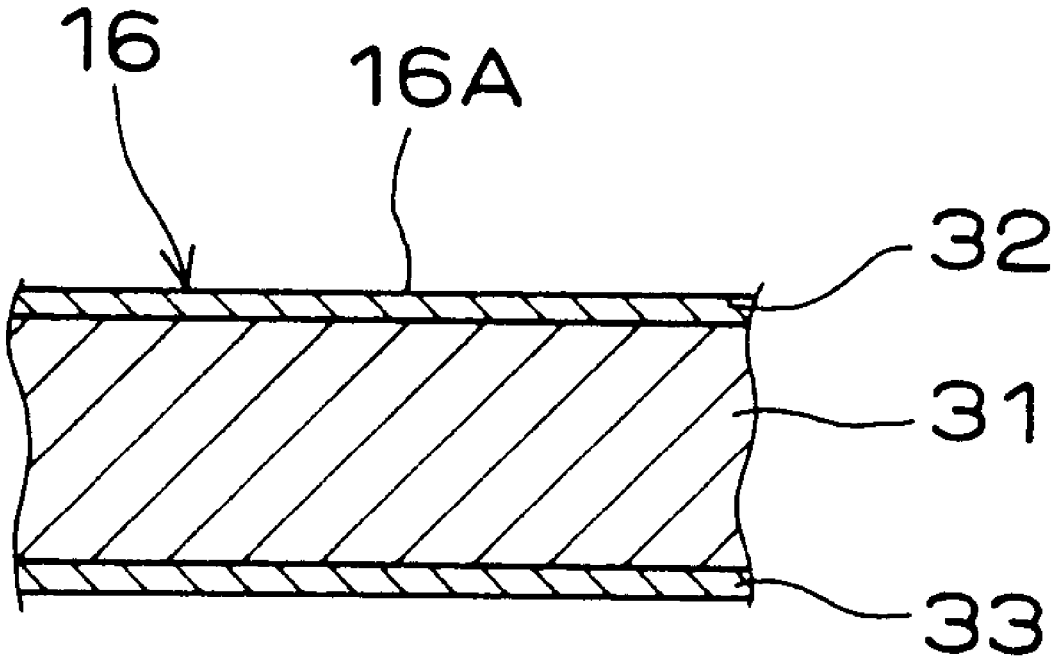
FIG. 3 is an enlarged vertical section of a wall thereof.

A peep show toy 1 shown in FIG. 1 is a hollow cube 10 formed by six translucent walls 11 to 16, each of which is square and about 1 to 5 mm thick. An edge of the square is about 5 to 20 cm long. As shown in FIG. 3, each of the walls consists of a white foam styrene plate 31, to both faces of which white Kent paper 32 and 33 are respectively fastened. In the light, whether the peep show toy 1 is disposed indoors or outdoors, a portion of rays of light is transmitted from the outside through the translucent walls 11 to 16 to the inside of the hollow cube 10. Thus the whole of the interior thereof is subjected to indirect illumination. When the observer looks at the interior through the observation hole 21, he is hardly conscious of the edges of the hollow cube 10.

The observation hole 21 is provided in a corner of the hollow cube 10 such that a plane in which the cut end of the observation hole 21 lies is perpendicular to a diagonal on which the aforesaid corner lies. The observation hole 21 is large enough to allow the observer to look into the interior thereof with one eye.

As shown in FIG. 4, on the inner surfaces 14A to 16A of the walls 14 to 16 which can be seen through the observation hole 21, pictures FG are drawn in perspective with a visual point disposed at the observation hole 21.

The pictures FG consist of pictures FG1 to FG3, which are coherent as a whole. Characters taking their poses on the first and second floors of a building appear in the pictures FG1 to FG3. A portion of the picture FG2 drawn on the inner surface of the wall 15 is projected into the inner surface of the wall 16. A portion of the picture FG3 drawn on the inner surface of the wall 14 is projected into the inner surfaces of the walls 15 and 16. The observer looks at pictures FG1 to FG3 with one eye through the observation hole 21 shown in FIG. 1. This means that a visual point for the pictures FG1 to FG3 is disposed at the observation hole 21.

In FIG. 4, a border line LB1 between the walls 15 and 16 and a border line LB2 between the walls 14 and 16 are shown by dashed lines to help explain the construction, but invisible to the observer. These border lines cannot be recognized by the observer. A plurality of lines drawn on the inner surfaces of the walls 14 and 15 are creased on the border lines LB1 and LB2.

The picture FG2, which is creased on the border line LB1, bestrides the boundary between the walls 15 and 16. For example, radiating lines appearing on the lower right of the picture FG2 are converted into vertical lines when they cross the border line LB1. Likewise the picture FG3, which is creased on the border line LB2, bestrides the boundary between the walls 14 and 16. Thus, radiating lines appearing on the picture FG3 are converted into horizontal lines when they cross the border line LB2. The reason for the necessity of such conversion is that the walls 14 to 16 are perpendicular to each other when they are assembled and when they are seen through the observation hole 21. Thus, the pictures appearing on these walls look different from those appearing on the development. In other words, although the radiate lines are creased on the development, each of them looks like a straight line when it is seen through the observation hole 21.

Since the border lines LB1 and LB2 are invisible to the observer, the three walls 14 to 16 are not recognized as three walls, but the interior of a hollow cube 10 (FIG. 1) is recognized by the observer as a three-dimensional space expressed by the pictures FG1 to FG3. Although the peep show toy 1 utilizes the space defined by the hollow cube 10, a free space which is not confined by the shape of the hollow cube 10 is created.

For example, when the pictures FG are an abstract painting drawn in perspective, an abstract three-dimensional space is created in the hollow cube 10. When a rectangular prism is drawn as the pictures FG, they will confuse the observer into thinking that the interior of the hollow cube 10 is shaped like a rectangular prism. When a spherical surface is drawn as the pictures FG, they will confuse the observer into thinking that the interior of the hollow cube 10 is shaped like a spherical surface.

When the pictures FG are a landscape drawn in perspective, depicting, e.g., Mt. Fuji, a large bridge spanning a strait, or the universe, a three-dimensional landscape is created in the hollow cube 10, with which the observer can amuse himself.

The peep show toy 1 is simple in construction, relatively lightweight and inexpensive in cost, and suitable for individual use. The observer can amuse himself with a landscape, portrait, history picture or narrative.

Reference will now be specifically made to the peep show toy kits 3 (FIG. 5) and 3*a* (FIG. 11) with which the peep show toy 1 can be assembled.

The main body of the peep show toy 1 is the hollow cube 10, in connection therewith storage and carriage are a major problem due to the bulky nature of such toys. Accordingly, it is an important object of the present invention to supply peep show toy kits 3 and 3*a* wherein the peep show toy 1 may be reduced in volume to such an extent as to make its storage and carriage readily available.

Figure 5:
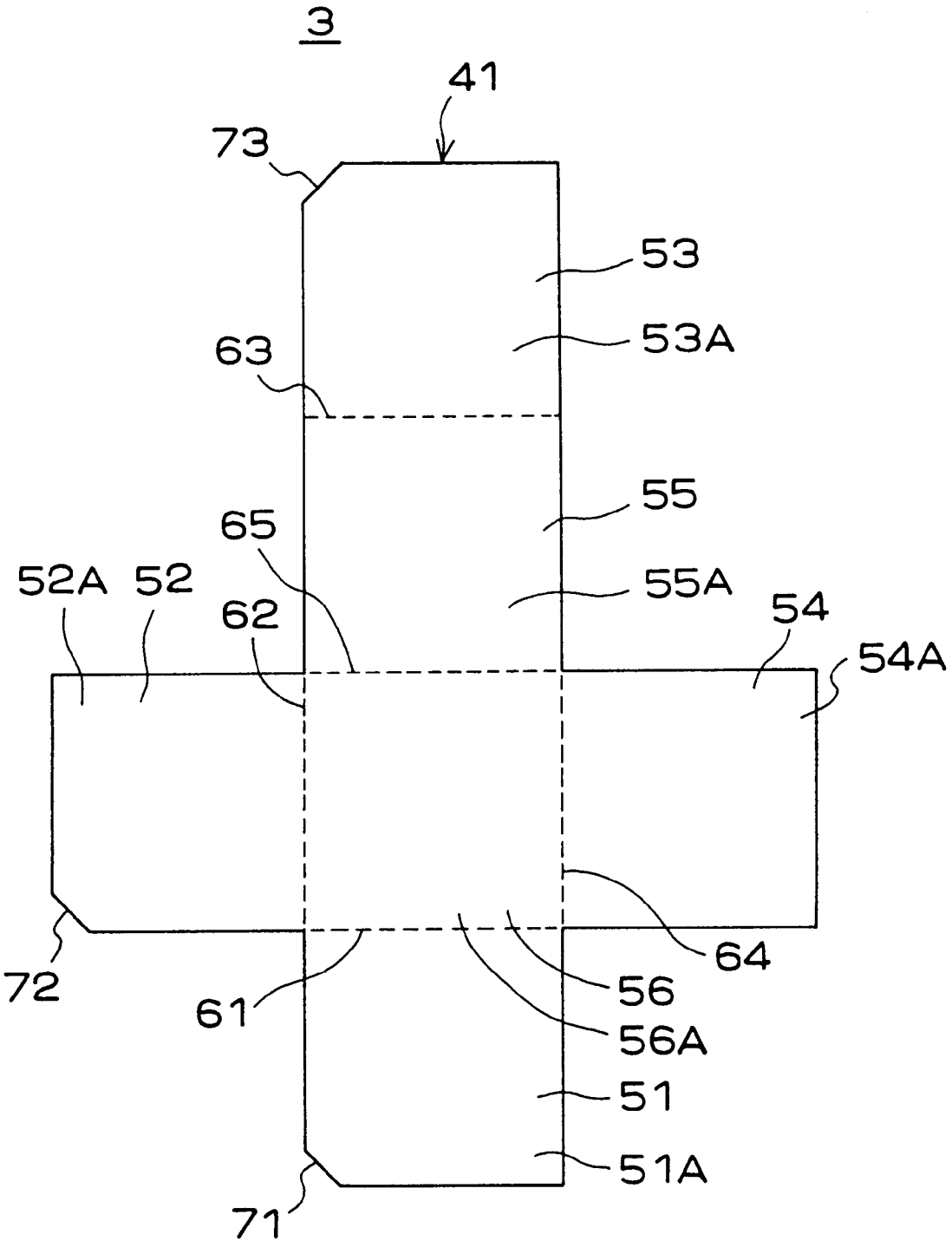
FIG. 5 shows the development of a sheet included in a peep show toy kit in accordance with the present invention.

FIG. 5 shows a development sheet 41 included in the peep show toy kit 3, which further includes nine sheets 42 (FIG. 6), three sheets 43 and one sheet 44.

As shown in FIG. 5, the developed sheet 41 comprises six translucent walls 51 to 56 connected with each other. A hollow cube 10*a* (FIG. 7) is formed when the sheet 41 has been creased along creases 61 to 65. An observation hole 21*a* is provided by indentations 71 to 73 in one of the corners of the hollow cube 10*a*.

Figure 8:
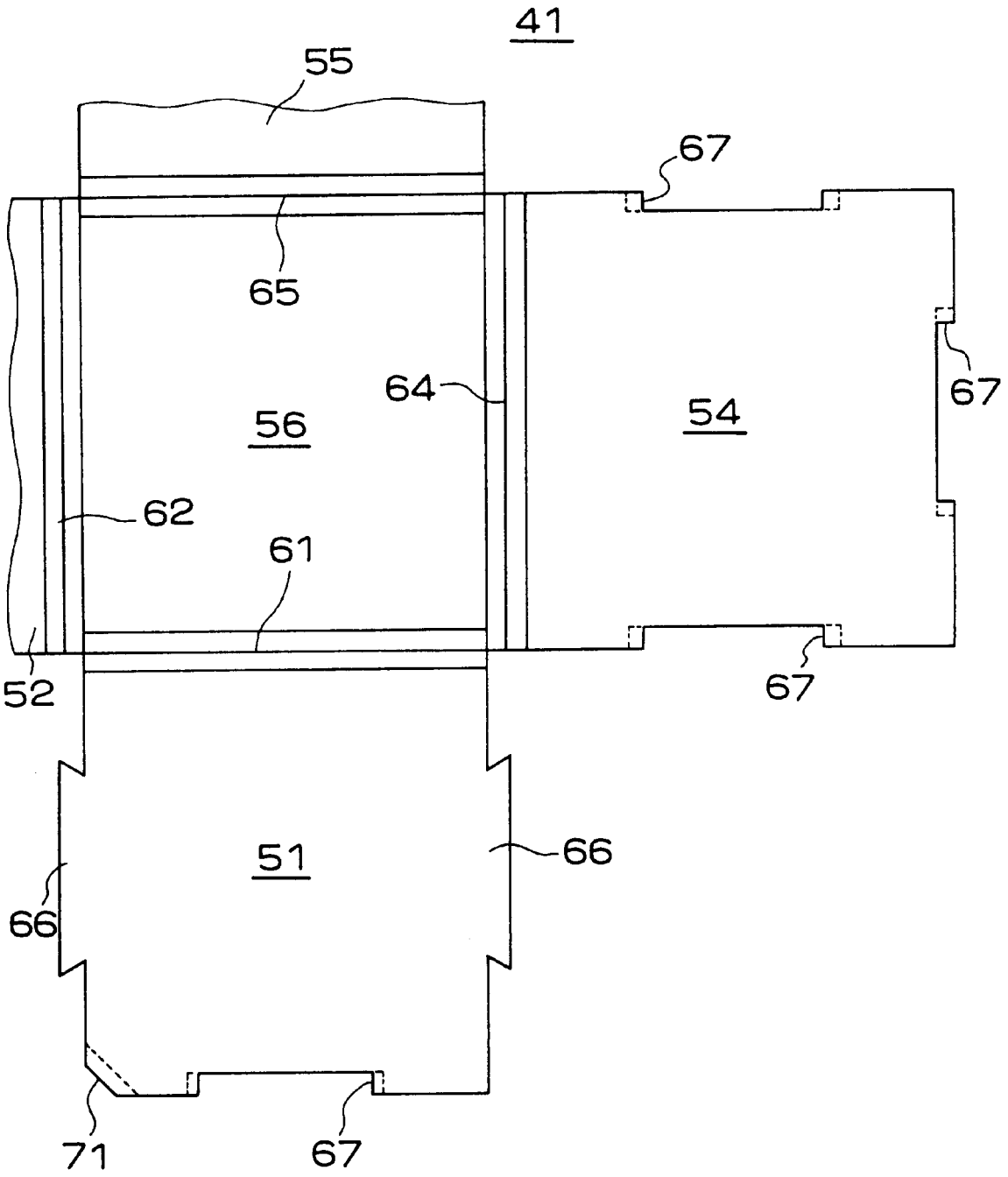
FIG. 8 is an enlarged view of a portion of the sheet shown in FIG. 5.
Figure 9A:
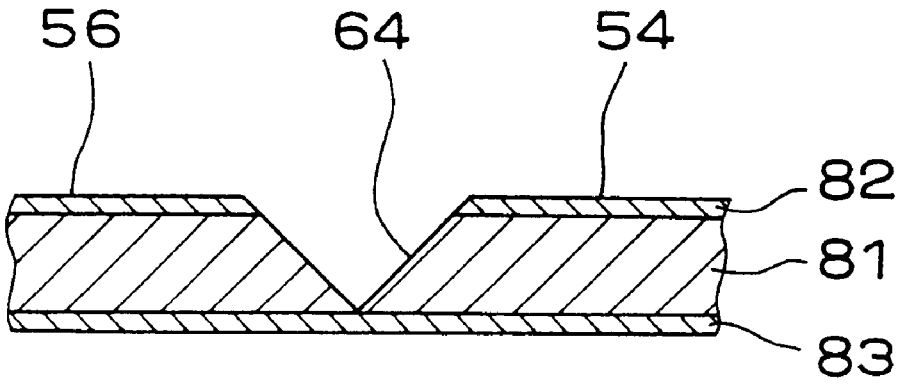
FIG. 9 shows a sectional view of a crease and an end view of a dovetail mortise.
Figure 9B:
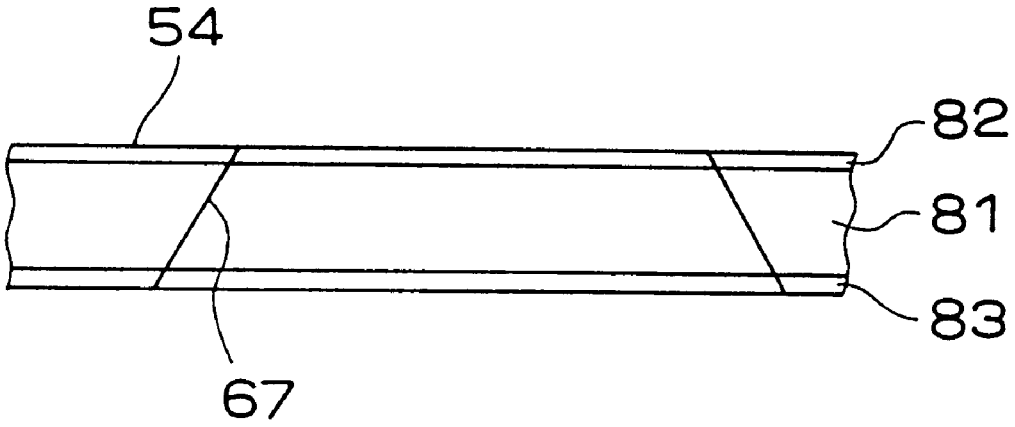
Figure 10:
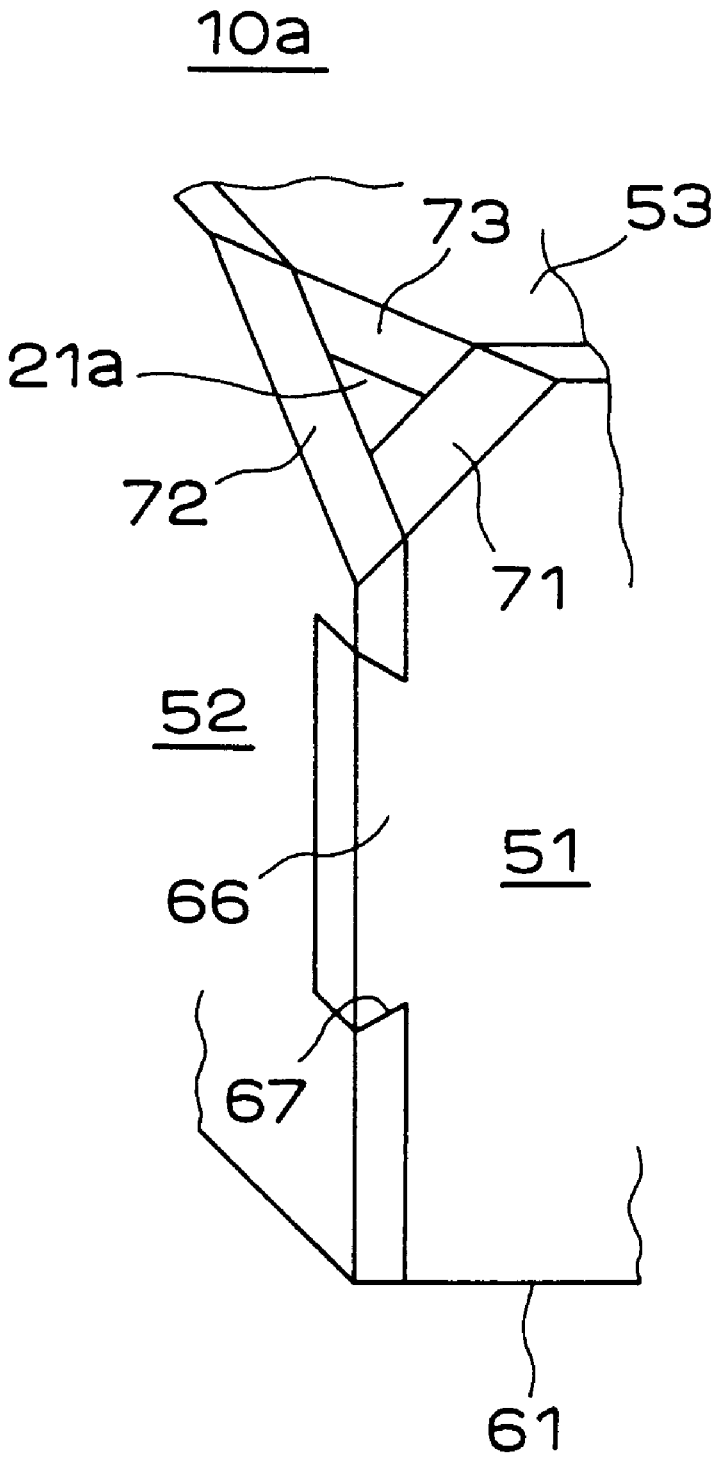
FIG. 10 is a view illustrating the dovetail mortise receiving a dovetail tenon at an edge of the peep show toy in accordance with the present invention.

Referring now to FIGS. 8 and 9, the material for the sheet 41 is the same as that for the aforesaid walls 11 to 16. In other words, the sheet 41 consists of a foam styrene plate 81, to both faces of which Kent paper 82 and 83 are respectively fastened. The foam styrene plate 81 can be obtained from a variety of commercial sources e.g., under the trade name STYRENE BOARD and may be stamped out so as to be shaped like the sheet 41 shown in FIG. 5. The sheet 41 is about 2 to 5 mm thick, preferably about 3 mm thick. The edge of each wall is about 10 cm long. The creases 61 to 65 are of V-shaped cross-section as shown in FIG. 9(A). When the sheet 41 has been creased, a dovetail tenon 66 is received by a dovetail mortise 67. If one resorts to Thomson's method, the work of stamping out the sheet 41 and cutting the creases into a cross-section can be carried out in a single process.

The sheets 42 to 44 shown in FIG. 6, with which the edges of the hollow cube 10*a* are covered, aim at preventing light beams from shining into the interior of the hollow cube 10*a* through gaps at the edges of the hollow cube 10*a*.

Figure 6A:
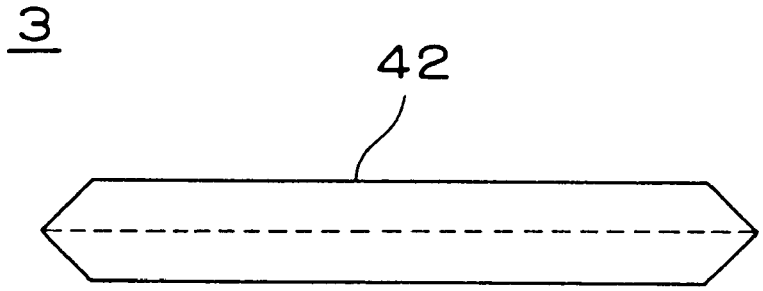
FIGS. 6(A), 6(B), and 6(C) are views illustrating sheets which are used to cover the edges of a peep show toy in accordance with the present invention.

As shown in FIG. 6(A), the sheet 42 has V-shaped ends, each of which takes the form of a rectangular equilateral triangle. The distance between right-angled vertexes is equal to the length of an edge of the hollow cube 10*a*. The sheet 42 is creased along the dashed line.

Figure 6B:
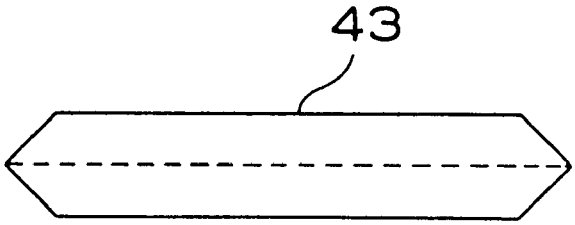

The shape of the sheet 43 shown in FIG. 6(B) is the same as that of the sheet 42, but sheet 43 is shorter than sheet 42.

Figure 6C:
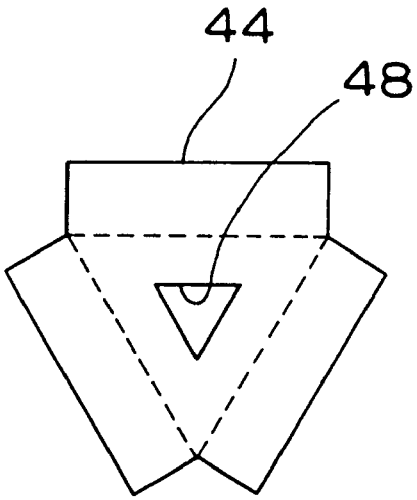

As shown in FIG. 6(C), the shape of the sheet 44 is such that each edge of a regular triangle has an overlap width in the form of a rectangle. An observation hole 48 in the form of a regular triangle is provided in the center. The shape of the observation hole 48 is the same as that of the observation hole 21*a*, the peripheral portion of which is covered with the sheet 44.

The sheets 42 to 44 are made up of black paper, oilpaper or resin sheets, and have reverse sides coated with an adhesive. Alternatively, the sheets 42 to 44 may be made of a vinyl adhesive tape. They have only to be nontransparent and easy to be fastened to the hollow cube 10*a*. Their color and translucency should be selected according to the translucency of the walls 51 to 56.

For the purpose of selling the peep show toy kit 3, the sheet 41 and the sheets 42 to 44 are put into a vinyl bag. The peep show toy kit 3 is reduced in volume as to make its storage and carriage readily available. Because of the indentations 71 to 73 disposed as shown in FIG. 5, the pictures FG with a visual point disposed at the observation hole 21*a* can be drawn on the walls 54 to 56. It will of course be apparent to those skilled in the art that the indentations 71 to 73 and the pictures FG may be disposed differently from those shown in FIG. 5.

There shall now be described one utilization of the peep show toy kit 3.

Pictures are drawn by a purchaser on the inner surfaces 54A to 56A of the walls 54 to 56 in a manner similar to the pictures FG drawn on the inner surfaces 14A to 16A of the peep show toy 1. Instead of directly drawing pictures on the inner surfaces 54A to 56A, pictures may be drawn on another paper or on a transparent film which is fastened to the inner surfaces 54A to 56A. Alternatively, photographs may be fastened thereto or print pictures may be placed thereon by means of a printer. The inner surfaces 51A to 53A may also bear pictures. The outer surfaces of the hollow cube 10*a* may contain design, etc provided they do not have an adverse effect upon the pictures on the inner surfaces.

Figure 7:
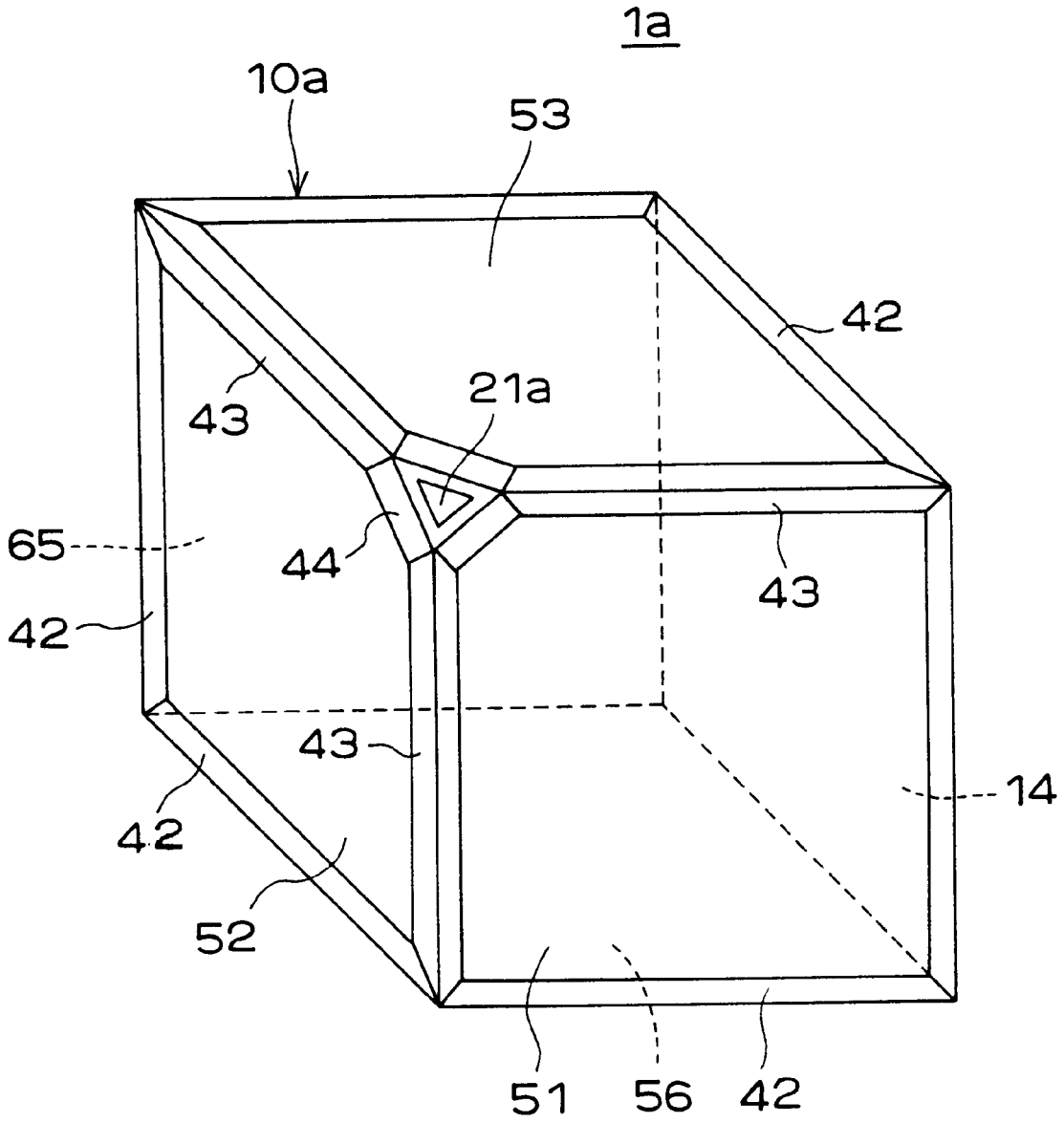
FIG. 7 is a perspective view illustrating the appearance of an assembled peep show toy with the sheets shown in FIGS. 5 and 6.

A hollow cube 10*a* is formed when the sheet 41 has been creased along creases 61 to 65 and the dovetail tenon 66 has been received by the dovetail mortise 67, which may be coated with an adhesive. Edges of the hollow cube 10*a* and the peripheral portion of the observation hole 21*a* are covered with the sheets 42 to 44. Thus the peep show toy 1*a* of FIG. 7 is finished.

The observer, who looks at the interior of the hollow cube 10*a* with one eye through the observation hole 21*a*, recognizes a three-dimensional space expressed by the pictures FG. Also, pictures can be drawn to one's own taste for amusing himself with an assembled peep show toy. The peep show toy kit 3 is suitable for use as a teaching aid in schools or for pleasure as a hobby.

Figure 11:
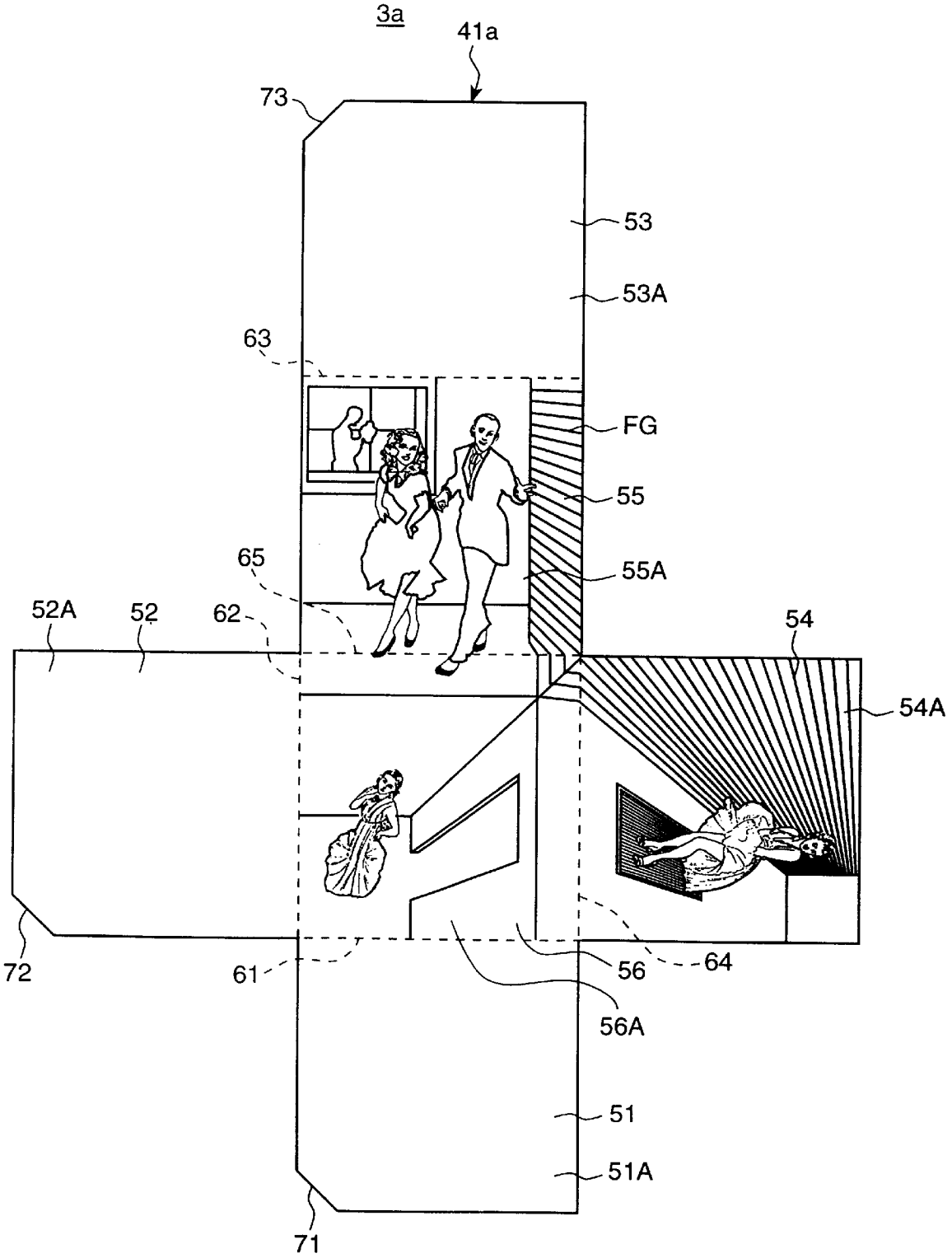
FIG. 11 shows the development of a sheet included in another peep show toy kit in accordance with the present invention.

Reference will now be specifically made to the peep show toy kit 3*a* shown in FIG. 11, in which the developed sheet 41*a* therefor is shown.

The kit 3*a* differs from the kit 3 by the fact that the pictures FG are printed beforehand on the inner surfaces 54A to 56A of the walls 54 to 56 and the purchaser has only to assemble the sheet 41*a* into a hollow cube 10*a* and fasten the sheets 42 to 44.

Instead of printing the pictures FG beforehand, photographic emulsion layers may be formed on the inner surfaces of the walls 54 to 56 so that photographs may be printed out. Alternatively, either photographs or paper on which the pictures FG are printed beforehand may be included in the kit so that they may be fastened to the walls 54 to 56 of the sheet 41*a* by the purchaser.

In the aforesaid embodiments, the observation hole 21 or 21*a* is provided in one of the corners of the hollow cube 10 or 10*a*. However, the observation hole may be provided in the vicinity of a corner or in the middle portion of a wall. According to the position of the observation hole 21 or 21*a*, the walls on which the pictures FG are drawn and the visual point on which the pictures drawn in perspective are based, may be changed.

In the aforesaid embodiments, each of the walls 11 to 16 or 51 to 56 consists of a foam styrene plate. However, other kinds of synthetic resin plates, frosted glass, mat glass, Kent paper, cardboard, cellophane paper, or a laminate consisting of at least two selected from the group of a resin plate, glass, paper, film and cloth may be used, provided that they are semitransparent. The walls may be molded by subjecting a synthetic resin to injection molding.

Alternatively, transparent glass, a transparent acrylic plate or a bright film may be used. In this case a surrounding background such as a blue sky, night sky, sea, field or snow scene, which is seen through the transparent walls, should be taken into account in drawing the pictures FG. If the pictures FG are drawn, an observe can amuse himself with his own personalized assembled peep show toy. For example, the sea should be prescribed as a background when the pictures FG depict a large bridge spanning a strait. Then the observer has a fine view of the large bridge spanning a natural sea. Such a peep show toy is very suitable as a souvenir or a memento to be sold at a tourist resort.

The peep show toy 1 may have members projecting inwardly from the hollow cube 10 so as to be seen through the observation hole 21. A picture FGw having something to do with any of the pictures FG1 to FG3 is drawn on each of the members, which may be mounted on any of the walls 11 to 16. For example, a chandelier, furniture, bird, fictitious animal or character in a tale may be suitable as the picture FGw. The projecting members may be made up of paper, film or synthetic resin. Each member has an overlap width to be adhered to any of the walls 11 to 16. Alternatively, each member may be suspended from any of the walls 11 to 16 by means of thread or wire. The projecting members may be enclosed with the peep show toy kit 3 or 3*a* as accessories.

Figure 13:
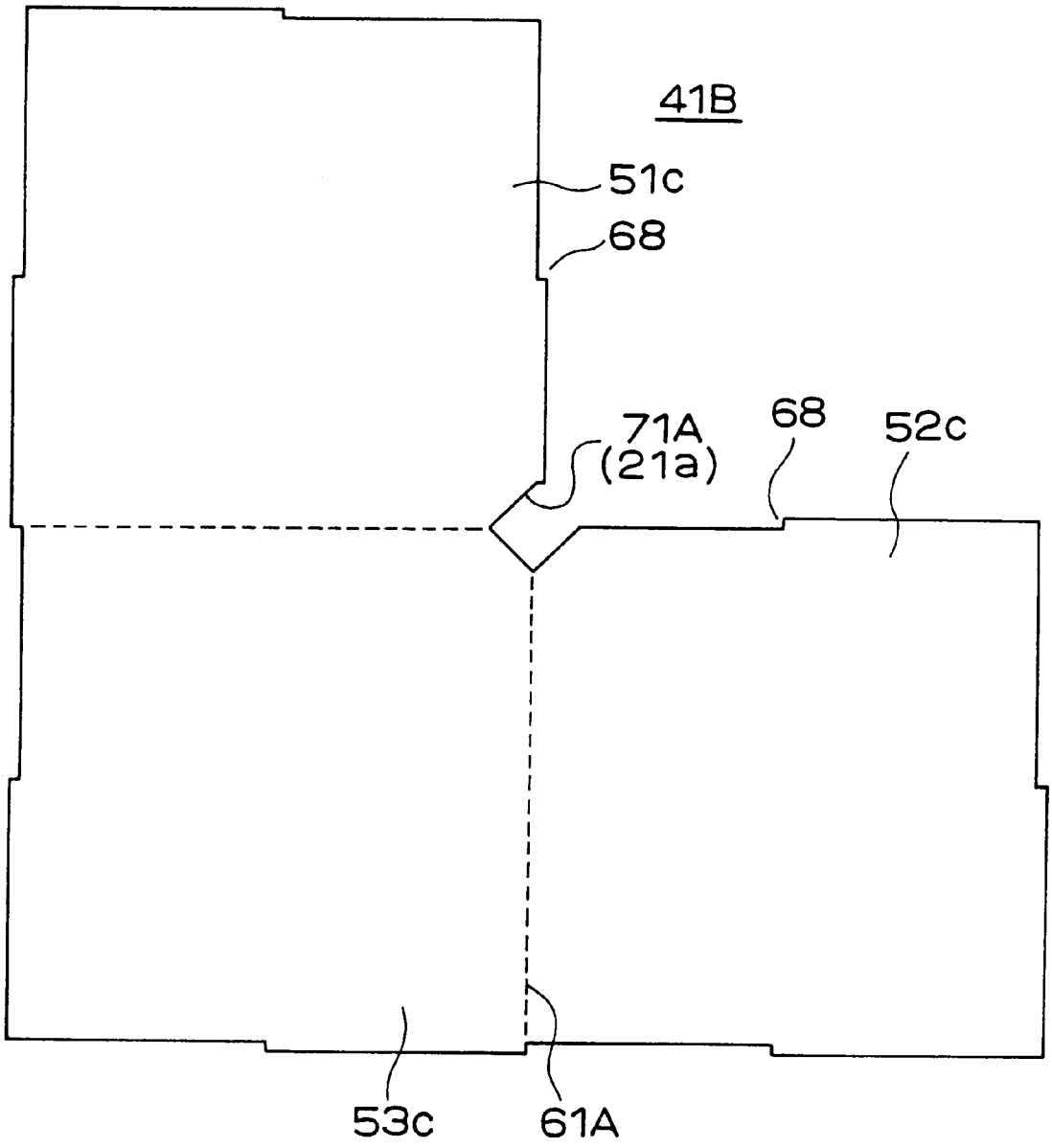
FIG. 13 shows the development of a sheet included in yet still another peep show toy kit in accordance with the present invention.

Reference will now be specifically made to another type of developed sheets 41A and 41B shown in FIGS. 12 and 13 respectively.

The sheet 41A consists of three walls 54C to 56C, while the sheet 41B consists of three walls 51C to 53C. Shoulders 68 equivalent to the thickness of the sheets 41A and 41B are formed to provide seats for abutting against corresponding shoulders 68.

The sheet 41A shown in FIG. 12 has three pictures FG4 to FG6 of a number of towering buildings drawn in perspective but in a manner creased along a border line between the walls 54C and 56C and along a border line between the walls 55C and 56C. On the other hand, nothing is drawn on the sheet 41B shown in FIG. 13, but an indentation 71A for forming an observation hole 21*a* is provided. Creases are indicated by dashed lines 61A.

A peep show toy 1*a* is formed when the sheets 41A and 41B have been creased along creases and combined with each other.

Projecting members similar to the aforesaid ones, on each of which an airplane, helicopter, bird, Superman or Mickey Mouse flying between the buildings is drawn, may be mounted on any of the walls 51C to 53C or 54C to 56C. These pictures FGw have great verisimilitude when seen through the observation hole 21*a*.

The sheets 41A and 41B have an advantage in that when they are stamped out, only a few portions of the material are wasted. Since the pictures FG have only to be printed on the sheet 41A, the manufacturing process can be simplified to such an extent as to be advantageous for mass production.

Figure 15A:
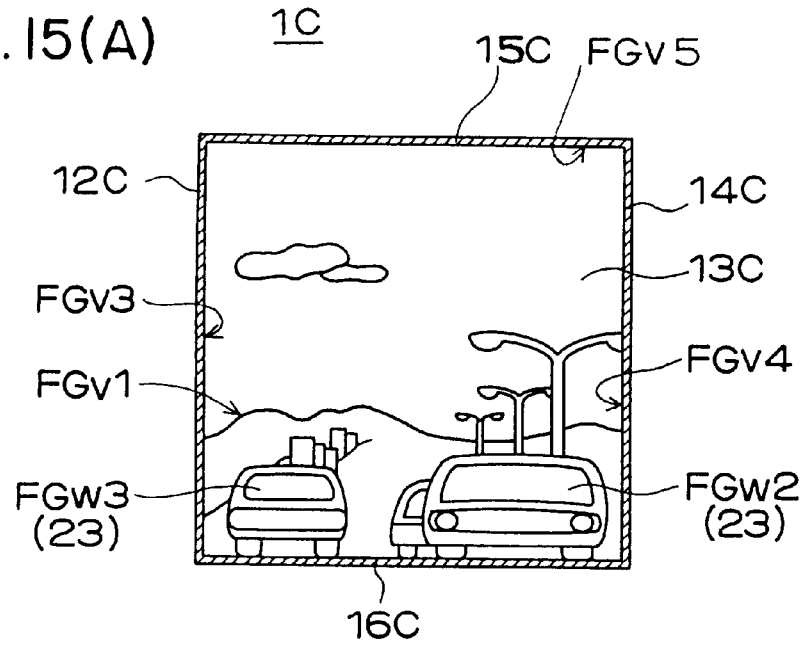
FIG. 15 shows a vertical section thereof and a horizontal section thereof.
Figure 15B:
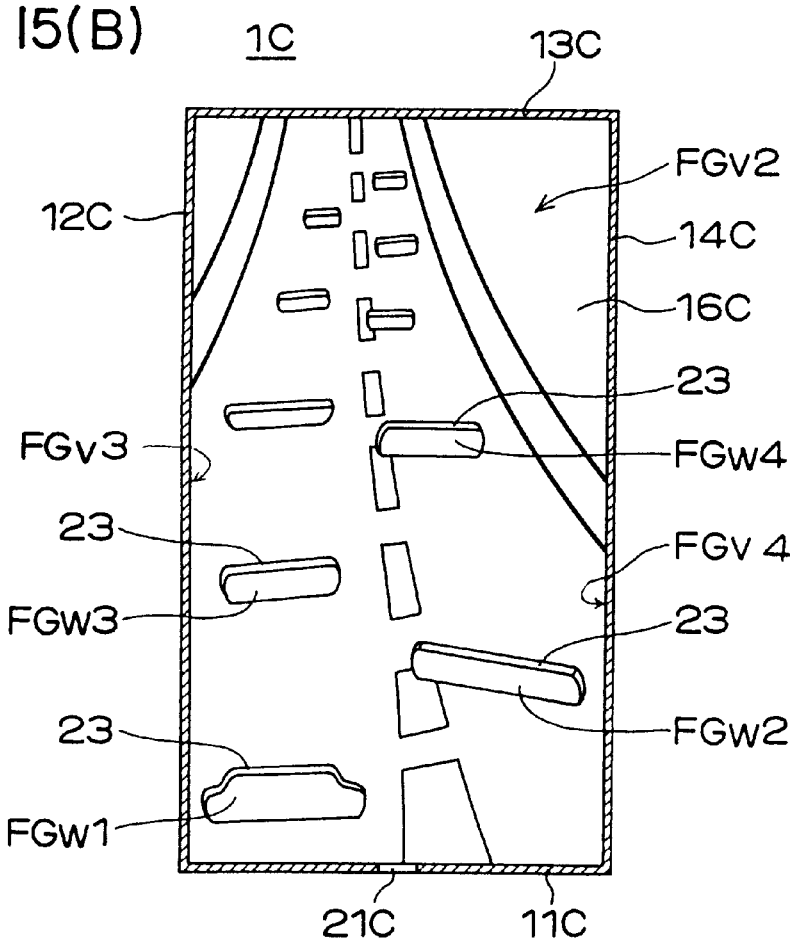

Reference will now be specifically made to another type of a peep show toy 1C shown in FIGS. 14, 15(A) and 15(B).

The peep show toy 1C takes the form of a hollow rectangular prism 10C having six walls 11C to 16C. An observation hole 21C, through which an observer can peep into the rectangular prism, is provided medially in a wall 11C which is perpendicular to the longer edges of the rectangular prism, and pictures FG7 are drawn therein in perspective with a visual point disposed at the observation hole 21C.

The pictures FG7 consist of pictures FGv1 to FGv5 drawn on the inner surfaces of the walls 13C, 16C, 12C, 14C and 15C respectively and pictures FGw drawn on projecting members 23 mounted on the inner surface of the wall 16C.

In FIG. 15(A), the picture FGv1 takes the form of the foreground of a thruway, which is drawn on the inner surface of the wall 13C disposed in front of the observation hole 21C. In FIG. 15(B), the picture FGv2 takes the form of the road surface of the thruway, which is drawn on the inner surface of the wall 16C. Pictures FGv3 to FGv5, which should be drawn on the inner surfaces of the walls 12C, 14C and 15C respectively, are not shown. Scenes outside the side windshields of an automobile and up in the sky may be suitable as pictures to be drawn thereon.

Pictures FGw take the form of automobiles preceding the observer and those running in the opposite lane. They are arranged in consecutively decreasing order of size in inverse proportion to the distance from the observation hole 21C. The material for the projecting members 23 is the same as that for the walls 11C to 16C. The projecting members 23 are adhered at their lower ends to the wall 16C in such an attitude as to slightly bend toward the wall 13C.

The pictures FG7 are drawn in perspective with a visual point disposed at the observation hole 21C. The pictures FGv1 to FGv5 and FGw may be either hand-worked pictures or photographs.

The observer looks at the pictures FG7 with one eye through the observation hole 21C. These pictures have great verisimilitude when seen through the observation hole 21C. Especially the projecting members 23 disposed in different positions serve to raise the sense of scenography.

In this embodiment, the pictures FGw depict automobiles. However, they may depict two-wheelers, persons, plant life such as flowers or trees, animals, characters appearing in comics or commercials. According to the pictures FGv, the pictures FGw may depict dolls, fishes, ships, rocks, rockets, stars or universe. In case where the microscopic world is depicted in the pictures FGv, the pictures FGw may depict molecules, electrons or atoms.

The projecting members 23 may be of plate type or three-dimensional. Transparent film may be used as material for the projecting members 23, on which the pictures FGw may be directly drawn.

The peep show toy 1C may have two observation holes so that the observer may be allowed to look at different situations.

For example, a golf course may be depicted in the hollow rectangular prism 10C. A golf ball may be depicted as flying over a putting green, while another golf ball may be depicted as being on/off course. Two observation holes may be provided in the wall 11C, one being a little to the right and the other being a little to the left. A back view of a golfer who has just swung a club may be depicted as a picture FGw and mounted on the wall 16C near the left-hand observation hole. A tree standing by the side of the golf course may be depicted as another picture FGw and mounted on the wall 16C near the right-hand observation hole.

When seen through the right-hand observation hole, a good shot made by the golfer can be seen because the golf ball on/off course is concealed behind the tree. When seen through the left-hand observation hole, a bad shot made by the golfer can be seen because the golf ball flying over the putting green is concealed behind the back view of the golfer. Thus the observer takes a greater interest in the pictures FG.

While this embodiment has been described particularly in connection with the hollow rectangular prism 10C, it will of course be apparent to those skilled in the art that this embodiment may be readily applied to a hollow frustum of a quadrangular pyramid, in which case the wall 13C may be a wall close to the vertex of the pyramid and the wall 11C may be a wall remote therefrom.

The trapezoidal walls 12C, 14C, 15C and 16C of this type of the peep show toy, together with the pictures FGv drawn thereon, serve to raise the sense of scenography.

Alternatively, this embodiment may be applied to a hollow quadrangular pyramid.

Alternatively, this embodiment may be applied to a hollow tetrahedron, octahedron, dodecahedron, trisoctahedron, hexagonal pyramid, sphere, cylinder or other solid partially having a spherical or curved surface such as a paraboloid. An observation hole or holes may be disposed accordingly.

Advantages achieved due to the arrangement of translucent walls may also be made possible by an arrangement of metal plates, metallic foil or thick cardboard. Such materials used for the walls in whole or in part will darken the interior of the peep show toy, but shadow caused thereby may be incorporated in the artistic presentation of the pictures FG. As occasion demands, a light emitting diode or an electric bulb may be mounted on the inner surface of a wall. Transparent film tinged with red or green may be fastened to the inner surfaces of the walls. Pictures FG per se may be tinged thereby. A portion of the walls may be made transparent. Alternatively, a wall may have an opening.

Should it be at any time desired to change the shape, material, dimensions, color or position of any of the components of the sheet 41 (FIG. 5), creases 61 to 65, dovetail tenon 66 (FIG. 8), dovetail mortise 67, walls 11 to 16 (FIG. 1) or projecting members 23 (FIG. 15) or pictures FG drawn thereon, changes in the specification and drawings may be made without departing from the spirit of the invention and the scope of the appended claims.

What is claimed is:

1. A peep show toy which comprises:

a hollow body which is a regular hexahedron formed by six planar walls made of a translucent material, an observation hole provided in a vertex of said hollow body and through which an observer can peep into said hollow body, and a picture in perspective having a visual point located in the position of said observation hole and which is provided on the inner surface of at least one of said six planar walls visible through said observation hole.

2. The peep show toy of claim 1, wherein said picture is provided on the inner surface of at least three of said six planar walls visible through said observation hole.

3. The peep show toy of claim 1, wherein said hollow hexahedron is in the form of a hollow cube and said observation hole is provided in one of the corners of said hollow cube.

* * * * *